US005369846A

United States Patent [19]

Suarez et al.

[11] Patent Number: 5,369,846

[45] Date of Patent: Dec. 6, 1994

[54] MOLDED-IN LOCKING PIN FOR BELT CLIP AND LANYARD

[75] Inventors: Gustavo G. Suarez, Deerfield Beach; Evencio Fernandez; Stefan Peana, both of Boca Raton, all of Fla.

[73] Assignee: Motorola, Inc., Schaumburg, Ill.

[21] Appl. No.: 55,898

[22] Filed: May 4, 1993

[51] Int. Cl.[5] ..... A44B 21/00

[52] U.S. Cl. ..... 24/35; 16/380; 16/382; 29/434; 29/469

[58] Field of Search ..... 24/3 R, 3 L, 3 H, 3 J, 24/511, 510, 509, 500, 499, 489; 224/252, 269; 16/380, 260, 382; 29/434, 436, 469

[56] References Cited

U.S. PATENT DOCUMENTS

| | | | |
|---|---|---|---|
| 1,109,074 | 9/1914 | Lamon | 16/380 X |
| 4,083,481 | 4/1978 | Selinko | 24/3 R X |
| 4,780,934 | 11/1988 | Vickers et al. | 24/3 J |
| 4,881,150 | 11/1989 | Oyamada | 24/3 J X |
| 4,956,895 | 9/1990 | Hayasaka | 24/3 J |
| 5,185,906 | 2/1993 | Brooks | 24/511 X |

*Primary Examiner*—James R. Brittain

*Attorney, Agent, or Firm*—Kelly A. Gardner; John H. Moore

[57] ABSTRACT

An apparatus is adapted for attaching to an article, wherein the apparatus comprises a housing (500) having a molded locking feature (510) substantially adjacent to a guide (550). A clip is mounted on the main housing (500), wherein the clip (508) further comprises a pin (506) having first and second ends, and a holder (860) adapted for mounting on the housing (500) via the guide (550), and having first and second shoulders (542, 540), each shoulder having a boss for receiving the pin therethrough. A member (508) has a third shoulder (532) having a boss for receiving the pin therethrough and has a fourth shoulder (530) having a sealed boss for receiving the pin thereat. The third shoulder (532) is substantially aligned and adjacent to the first shoulder (542) and the fourth shoulder (530) is substantially aligned and adjacent to the second shoulder (540) such that the first end of the pin is inserted through the boss of the first, second, and third shoulders and partially into the sealed boss of the fourth shoulder thus holding the member (508) and the holder (860) together. The clip attaches to the housing (500) at the guide (550) such that the second end of the pin pushes against an inside surface of the molded locking feature (510) wherein the pin is held in position between an inside surface of the sealed boss and the inside surface of the molded locking feature (550).

18 Claims, 3 Drawing Sheets

-PRIOR ART-

-PRIOR ART-

-PRIOR ART-

-PRIOR ART-

MOLDED-IN LOCKING PIN FOR BELT CLIP AND LANYARD

FIELD OF THE INVENTION

This invention relates generally to belt clips, and more particularly to a belt clip having an improved locking pin and lanyard option.

BACKGROUND OF THE INVENTION

Selective call receivers (also known as pagers) have been available for several years and the technology used therein is well known. In its basic form, a selective call receiver is a miniature radio receiver that can be carried on a user's person for receiving radio transmitted messages. Each selective call receiver has a unique address, and when that unique address is received, the selective call receiver alerts the user of a following received message. Selective call receivers, then, allow the user carrying the selective call receiver to receive a page providing that user with a message or notice while the user is away from an office or phone. The page may be a simple beep for alerting the user to call a predetermined telephone number for a message. Alternatively, the page may be more complex, for example, a telephone number or an alphanumeric message displayed on the selective call receiver's message display, or stock quotes or news information received from a news and information service for down-loading into a personal computer from the selective call receiver, etc. Selective call receivers also typically include a variety of accessories. For example, an acknowledge circuit might be included on the selective call receiver for sending a signal back to a transmitter to verify that a page has been received. Additionally, selective call receivers may use a speaker, a flashing LED (light emitting diode), and/or a tactile alert such as a vibrator to alert the user of a received page. Additional features can include backlit displays, improved antennas, low battery alert, etc.

Competition in the selective call receiver market demands that additional features be provided, and further that the selective call receivers maintain small form factors. Selective call receivers, for example, are now offered in small form factors that can unobtrusively be carried on a belt, on a wrist as a wristwatch pager, or in a pocket in a thin form factor roughly the size of a credit card (credit card or thin form factor).

Consumer demands for less expensive, smaller selective call receivers have been met, in part, by offering some functions for selective call receivers as accessories and not as a standard part of a purchased selective call receiver. To further reduce costs, designers continually look to methods of reducing costs of features presently available. For example, two common methods of carrying selective call receivers upon a user's person include clipping the selective call receiver to a belt, or connecting the selective call receiver to a lanyard accessory. A simple pin used to hold a clip to the housing can cost ten cents or more. If the cost of such a pin could be reduced to a penny or less while simultaneously offering a lanyard accessory option, then a selective call receiver could be made less expensively. A savings of even a few cents per selective call receiver is substantial considering that millions of selective call receivers are sold each year.

Thus, what is needed is a selective call receiver having a new pin for holding a belt clip to a housing, which pin is substantially reduced in cost while offering an additional feature.

SUMMARY OF THE INVENTION

According to a first aspect of this invention, an apparatus is adapted for attaching to an article, wherein the apparatus comprises a housing having a molded locking feature substantially adjacent to a guide. A clip is mounted on the main housing, wherein the clip further comprises a pin having first and second ends, and a holder adapted for mounting on the housing via the: guide, and having first and second shoulders, each shoulder having a boss for receiving the pin therethrough. A member has a third shoulder having a boss for receiving the pin therethrough and has a fourth shoulder having a sealed boss for receiving the pin thereat. The third shoulder is substantially aligned and adjacent to the first shoulder, and the fourth shoulder is substantially aligned and adjacent to the second shoulder such that the first end of the pin is inserted through the boss of the first, second, and third shoulders and partially into the sealed boss of the fourth shoulder thus holding the member and the holder together. The clip attaches to the housing, via the holder, at the guide such that the second end of the pin is substantially near or against an inside surface of the molded locking feature wherein the pin is held in position between an inside surface of the sealed boss and the inside surface of the molded locking feature.

According to a second aspect of the invention, a method of attaching a clip to a housing is provided wherein the method comprises the steps of: (a) aligning a holder having a first flange to a clip having a second flange, wherein the first and second flanges each have a boss for receiving a pin therethrough; (b) pushing a distal end of the pin through the bosses of the first and second flanges for holding the holder and clip rotatably together; and (c) sliding the holder into guides located on the housing until a proximate end of the pin is aligned with a first molded locking feature located on the housing and adjacent to the guides, the holder locking into the guide, and wherein the distal end of the pin is substantially near a second molded locking feature.

DESCRIPTION OF A PREFERRED EMBODIMENT

Figure 1:
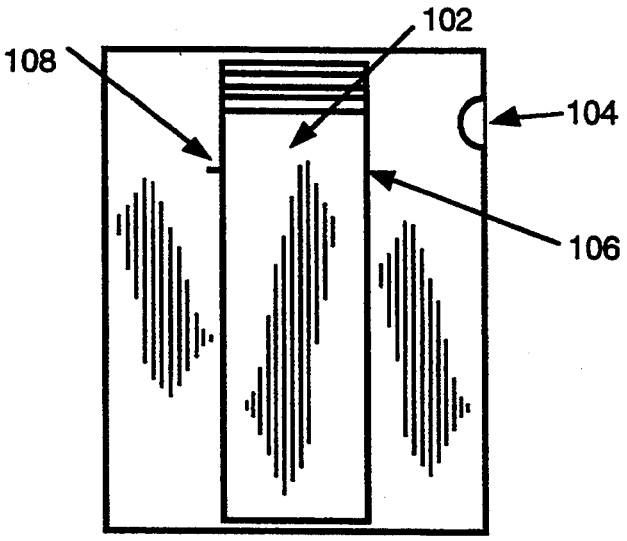
FIG. 1 is a pictorial diagram of a prior art selective call receiver having a lanyard pin incorporated into a housing of the selective call receiver.

FIG. 1 illustrates a prior art selective call receiver 100 having a snap fit belt clip 102 attached thereto. The snap fit belt clip 102 allows a user to temporarily attach the selective call receiver 100 to a belt or other article. A lanyard pin 104 is also available in the event that a user prefers to carry the selective call receiver on a lanyard cable or chain (not shown). The lanyard pin is made to be a part of a housing of the selective call receiver 100 and requires additional processing steps. The snap fit belt clip 102 may be removed by pressing a button, for example, and sliding the snap fit belt clip 102 and a holder (not shown) from the selective call receiver 100. A pin assembly, consisting of an E-clip 108 and a belt clip pin 106, holds the snap belt clip 102 to the holder such that the snap fit belt clip 102 rotates about the pin assembly. Given that the selective call receiver 100 is produced in large quantities, a small reduction in cost of manufacturing any of the component parts can, in the aggregate, provide substantial overall cost reductions. One way to reduce costs somewhat is to combine the pin assembly and the lanyard pin into a single unit.

Figure 2:
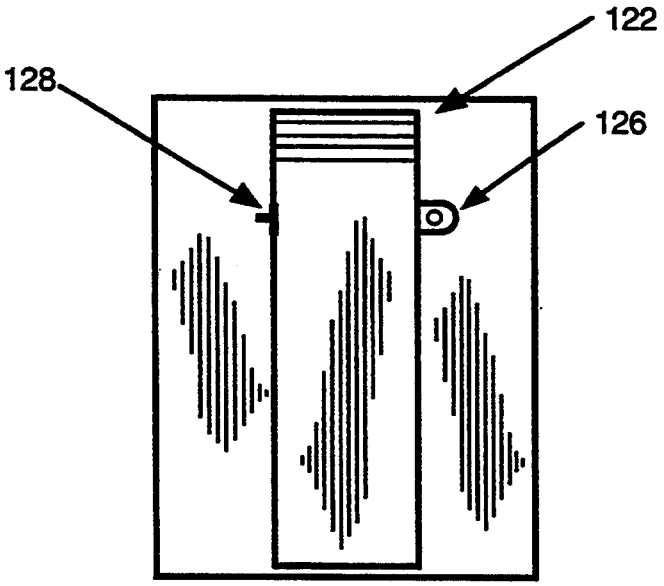
FIG. 2 is a pictorial diagram of a prior art selective call receiver having a lanyard pin incorporated into a belt clip pin.

Referring to FIG. 2, a prior art selective call receiver 120 is shown that combines a lanyard pin and the belt clip pin 126 into a single assembly. Production costs can be reduced since the previous steps necessary to add a lanyard pin to the housing have been eliminated.

Figure 3:
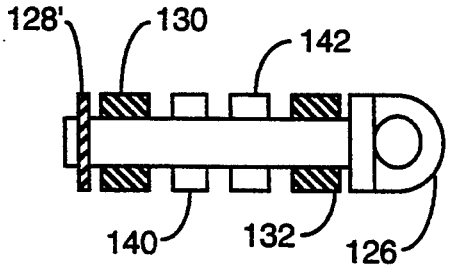
FIG. 3 is a pictorial diagram showing the prior art belt clip pin in greater detail.

FIG. 3 shows the combination lanyard pin/belt clip pin in greater detail. A mounting plate includes two shoulders 140 and 142, each having a boss for receiving a lanyard pin/belt clip pin 126' therethrough. A belt clip 122 (FIG. 2) includes two shoulders 130 and 132, each having a boss for receiving the lanyard pin/belt clip pin 126' therethrough when the shoulders 130 and 132 are properly aligned to the shoulders 140 and 142. An E-clip 128' is pressed onto an end of the lanyard pin/belt clip pin 126' for holding the belt clip 122 and the mounting plate together (i.e., a head of the lanyard pin/belt clip pin 126' and the E-clip 128' lock the lanyard pin/-belt clip pin 126' into place). The mounting plate is then slid into the housing of the selective call receiver 120 (FIG. 2). A leaf spring is typically inserted between the mounting plate and the belt clip 122 to cause the belt clip to press against the selective call receiver 120 housing.

Figure 4:
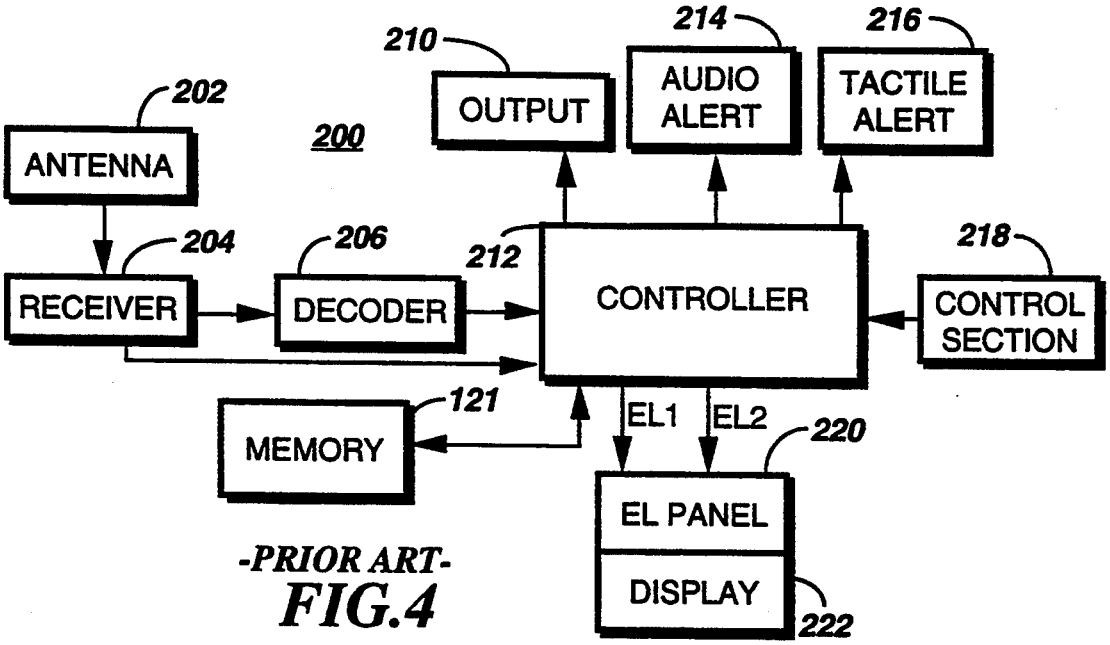
FIG. 4 is a schematic diagram of a prior art selective call receiver circuit:.

FIG. 4 illustrates a selective call receiver 200 (i.e., a pager) comprising an antenna 202 for providing an RF carrier signal that is mixed with a local oscillator signal contained within a receiver module 204. The receiver module 204 generates a recovered signal suitable for processing by a decoder 206 in a manner well known to those skilled in the art. The decoder 206 then converts the recovered signal into an address. A controller 212 compares the decoded address with one or more predetermined addresses stored in a memory 208. If the decoded address and one of the predetermined addresses are substantially similar, the user is alerted that a signal has been received either by an audio alert 214 (for example, a speaker) or by a tactile alert 216 (for example, a vibrator). The received signal may also include optional message data directed to some selective call receivers. Also, if the selective call receiver 200 includes an optional voice output, recovered audio portions of the received R.F. signal may be presented on an output module 210. The operation of a selective call receiver of the general type is well known and is more fully described in U.S. Pat. No. 4,518,961 issued May 21, 1985 and assigned to the same assignee as the present invention and is hereby incorporated by reference.

For the message display selective call receiver 200, the recovered message is stored in the memory 208 for subsequent presentation on a display. The display could be an integral part of the selective call receiver 200, such as EL panel 220, in which case the message display is-typically limited to 80 characters. The EL panel 220 is coupled to the controller 212 via lines EL1 and EL2. A display 222, shown as an integral part of the EL panel 220, will automatically, or when manually selected by controls 218, illuminate the message. A display 222 is not necessary to the present invention, for example, an audio display would suffice in beep only alerts, or in the case that only voice messages are provided. Alternatively, the display need not be an integral portion of the selective call receiver 200 if the selective call receiver 200 is coupled to a personal computer, for example, a laptop computer (not shown), in which case a substantially larger message area is available for displaying the message.

Figure 5:
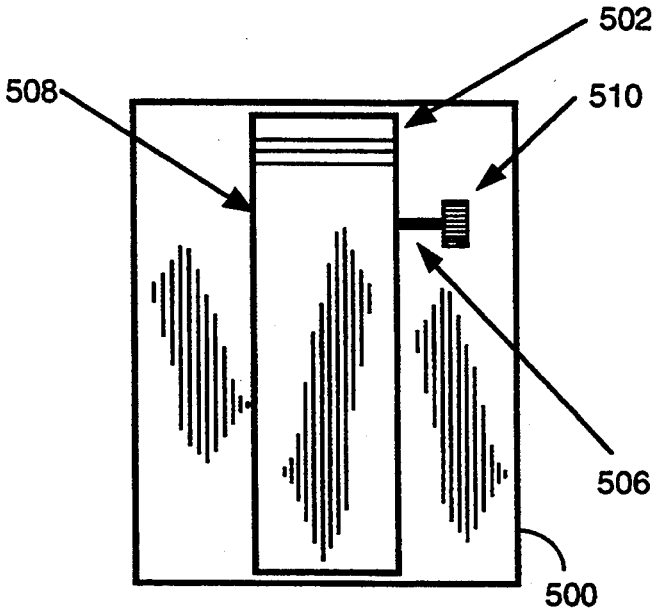
FIG. 5 is a pictorial diagram of belt clip pin having a lanyard accessory according to a preferred embodiment of the invention.

Referring now to FIG. 5, further cost savings may be realized by modifying a belt clip pin 506. A belt clip 508 is rotatably connected to a mounting bracket (not shown) by the belt clip pin 506. In the preferred embodiment of the present invention, the belt clip pin 506 is a straight pin which can be produced at a cost many times less than that of the belt clip pin 106 (FIG. 1) or the belt clip pin 126 (FIG. 2). Cost reductions are realized primarily by eliminating a need for secondary process steps previously required in manufacturing the belt clip pin 126.

Figure 6:
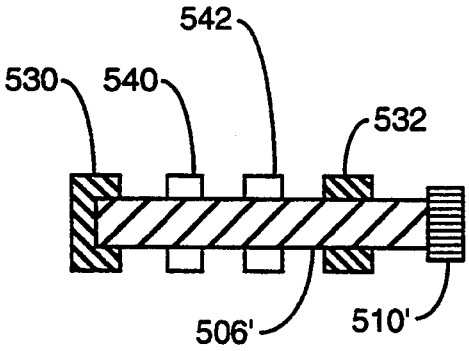
FIG. 6 is a pictorial diagram showing the belt clip pin according to a preferred embodiment of the present invention in greater detail.

FIG. 6 better illustrates the assembly of a belt clip 502. Similarly to the belt clip pin 126, a belt clip pin 506' is inserted through aligned bosses in shoulders 532, 540 and 542. Unlike the belt clip pin 126, however, a distal end of the belt clip pin 506' is inserted into a sealed boss of a shoulder 530. The shoulders 530 and 532 are an integral part of the belt clip 502, that is, the shoulders 530 and 532 are molded at the same time, and hence as part of the belt clip 502. The shoulders 540 and 542 are part of the holder (not shown), which holder slides into guides (not shown) until the holder snaps into position via latches or a similar fastening device. The guides are an integral feature of a housing 500. The holder may be snap fit for later removal, or alternatively, the holder may be permanently locked into place once inserted.

Figure 9:
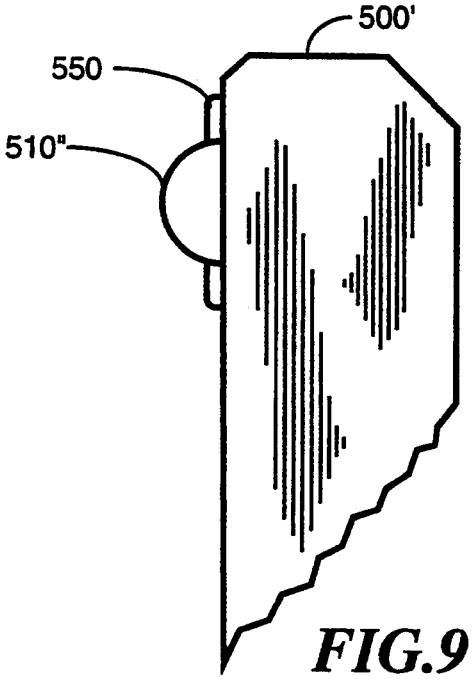
FIG. 9 is a side view pictorial diagram of a molded locking feature.

After the belt clip pin 506' is inserted into the shoulders 530, 532, 540 and 542, thus engaging the holder to the belt clip 502, the holder is slipped into the guides of the housing 500 until the bosses, and hence a proximate end of the belt clip pin 506' are aligned with a molded locking feature 510', at which point the holder would be prevented from traveling further by stops at the end of the guides. The holder is now locked or snapped into place, and the belt clip pin 506' is prevented from sliding out of the bosses by the sealed boss at the distal end and by the molded locking feature at the proximate end. The molded locking feature 510' is an integral part of the housing 500, that the molded locking feature is molded simultaneously, and as part of the housing 500. FIG. 9 shows a side view of a molded locking feature 510'' being an integral part of the housing 500'.

Figure 7:
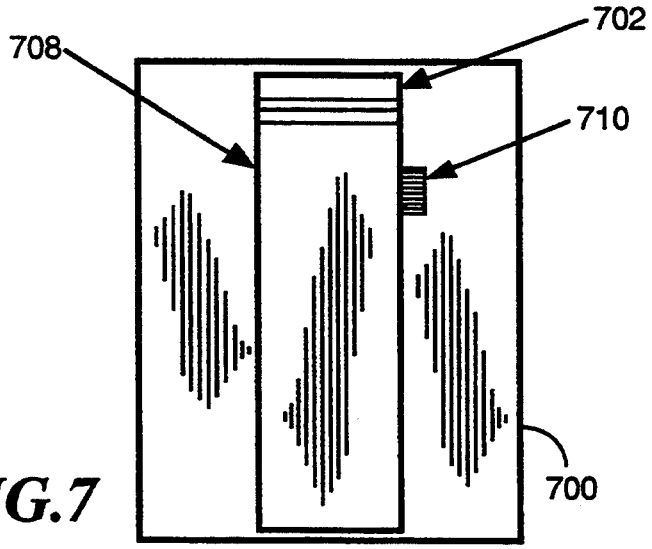
FIG. 7 is a pictorial diagram of belt clip pin of an alternative embodiment of the present invention.

A distance between the molded locking feature 510' and the shoulder 532 may be varied, and hence a length of the belt clip pin 506', for the purpose of providing a lanyard accessory (see FIG. 5). For example, FIG. 5 depicts a greater distance wherein a clip of a lanyard accessory may be coupled near the proximate end of the belt clip pin 506. As a result, the lanyard pin has effectively been provided at almost no additional cost. An option of a belt clip pin 710 which does not provide for a lanyard accessory is shown in FIG. 7. Furthermore, the distal and proximate ends need not fit snugly against an inside surface of the sealed boss and an inside surface of the molded locking feature 510', but merely close enough to prevent the belt clip pin 506 from falling out, or close enough to prevent a lanyard accessory from becoming separated. Looser production tolerances help further reduce production costs. Additionally, the parts counts has been reduced since the sealed boss is part of the belt clip 508' and an E-clip is no longer required.

Figure 8:
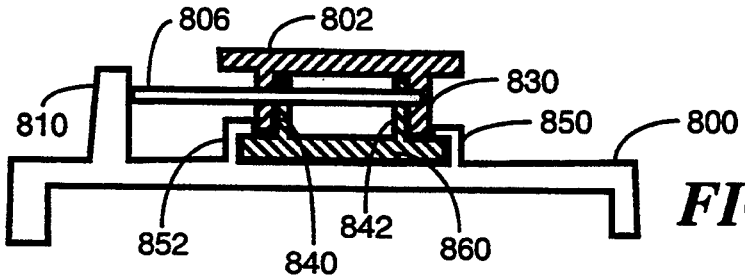
FIG. 8 is a cross sectional view of the belt clip pin of FIG. 6

FIG. 8 shows a cross sectional view of the belt clip assembly of FIG. 6, comprising a belt clip pin 806 inserted through bosses of shoulders 830, 832, 840 and 842. The shoulders 830 and 832 are integral to a belt clip 802, wherein the shoulder 830 now incorporates a sealed boss for acting as a stop for a distal end of the belt clip pin 806. A mounting bracket 860 is shown inserted into guides 850 and 852. The guides 850 and 852 are an integral part of a housing 800. A proximate end of the belt clip pin 806 rests against an inside surface of a molded locking feature 810. The shoulders 840 and 842 could be made to rest outside of the shoulders 830 and 832, with the sealed boss being formed in the shoulder 842, without departing from the present invention. Alternatively, the shoulders 830, 832,, 840, and 842 can be aligned such that one of the shoulders 840 is an inside shoulder while the shoulder 842 is an outside shoulder, etc. A spring (not shown) would be inserted between the belt clip 802 an the holder 860 for providing a tension to cause the belt clip 802 to rest against the housing 800 as necessary to secure the housing 800 to a belt, for example.

Figure 10:
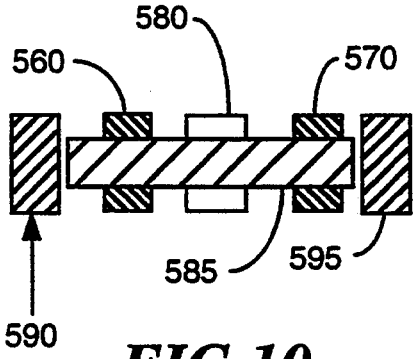
FIG. 10 is a pictorial diagram of an alternative embodiment of the present invention.

FIG. 10 is a pictorial diagram of an alternative embodiment of a belt clip assembly having a single shoulder 580, molded as an integral portion of a holder located between two shoulders 560 and 570 of a belt clip. The shoulders 560 and 570 are likewise molded as an integral portion of a belt clip. A pin 585 is inserted into bosses of the shoulders 560, 570, and 580 for holding the belt clip and holder together. The holder is then inserted into guides of a housing as before, but now the pin 585 is held in place by two molded locking features 590 and 595 located on either side of the pin 585.

It may be appreciated by now that there has been provided an improved belt clip assembly for holding a belt clip to a housing while providing a lanyard option. Costs of the assembly are reduced by easing production tolerances, reducing parts count, reducing the cost of the belt clip pin, and reducing the assembly steps by removing the need to add an E-ring. The belt clip pin, for example, can be quickly and accurately cut to size from a wire roll, the wire having the proper diameter for strength.

Although the present invention has been described in relation to particular embodiments thereof, many other variations and modifications and other uses will become apparent to those skilled in the art. Two embodiments of the invention have been described showing four and three shoulders respectively, but the number and relationship of the shoulders may be varied without departing from the scope of the present invention. Furthermore, other types of devices besides a selective call receiver may benefit from the reduced costs and parts required. Additionally, the invention need not be limited to articles carried on a user's person, but extends to mechanical applications where it is necessary to rotatably connect two pieces of materials together. Therefore, the present invention is limited only by the claims.

We claim:

1. An apparatus adapted for attaching to an article, the apparatus comprising:

a housing having a molded locking feature substantially adjacent to a guide;

a clip mounted on the housing, the clip further comprising:

a pin having first and second ends;

a holder adapted for mounting on the housing via the guide, and having a first shoulder, the first shoulder having a boss for receiving the pin therethrough;

a member having a second shoulder having a boss for receiving the pin therethrough and a third shoulder having a sealed boss for receiving the pin thereat, the second shoulder substantially aligned to the first shoulder, and third shoulder substantially aligned to the first shoulder such that the first end of the pin is inserted through the boss of the first and second shoulders and partially into the sealed boss of the third shoulder thus holding the member arid the holder together; and wherein the clip attaches to the housing at the guide such that the second end of the pin is substantially near an inside surface of the molded locking feature wherein the pin is held in position between an inside surface of the sealed boss and the inside surface of the molded locking feature.

2. The apparatus according to claim 1 wherein the molded locking feature is separated from the clip for exposing a portion of the pin such that a lanyard device may be connected to the exposed portion of the pin.

3. The apparatus according to claim 1 wherein the apparatus is a personal electronics device.

4. The apparatus according to claim 3 wherein the personal electronics device is a selective call receiver.

5. The apparatus according to claim 3 wherein the clip is a belt clip slidably mounted to the housing.

6. The apparatus according to claim 5 wherein the holder further includes a snap fit for snapping the holder to the housing.

7. The apparatus according to claim 1 wherein the holder further comprises a fourth shoulder having a boss for receiving the pin therethrough, the fourth shoulder substantially aligned to the first shoulder.

8. A personal electronics device adapted for carrying on a user's person, the apparatus comprising:

a housing having a molded locking feature substantially adjacent to mounting guides;

a belt clip mounted on the main housing, the belt clip further comprising;

a pin having a distal end and a proximate end;

a holder slidably mounted on the housing via the mounting guides, and having first and second flanges, the first and second flanges each having a boss for receiving the pin therethrough;

a clip having a third flange having a boss for receiving the pin therethrough and having a fourth flange having a sealed boss for receiving the pin thereat, the third flange substantially adjacent to the first flange, and the fourth flange substantially adjacent to the second flange such that the distal end of the pin is inserted through the boss of the first, second, and third flange and partially into the sealed boss of the fourth flange thus holding the clip and the holder together; and wherein the belt clip attaches to the housing such that the proximate end of the pin is pushed against the molded locking feature and the distal end is pushed against the sealed boss thus holding the pin in place.

9. The personal electronics device according to claim 8 wherein the molded locking feature is separated from the clip for exposing a portion of the pin.

10. The personal electronics device according to claim 9 further comprising a lanyard accessory, the lanyard accessory attached to the exposed portion of the pin.

11. The personal electronics device according to claim 10 wherein the personal electronics device is a selective call receiver.

12. The personal electronics device according to claim 9 wherein the pin is substantially straight.

13. An apparatus adapted for attaching to an article, the apparatus comprising:

a housing having first and second molded locking features located substantially adjacent to and on opposite sides of a guide;

a clip mounted on the housing, the clip further comprising;

a pin having first and second ends;

a holder adapted for mounting on the housing via the guide, and having a first shoulder, the first shoulder having a boss for receiving the pin therethrough;

a member having a second shoulder having a boss for receiving the pin therethrough, the second shoulder substantially aligned to the first shoulder such that the first end of the pin is inserted through the boss of the first and second shoulders thus holding the member and the holder together; and wherein the clip attaches to the housing at the guide such that the first end of the pins is substantially near an inside surface of the first molded locking feature, and the second end of the pin is substantially near an inside surface of the second molded locking wherein the pin is held in position between an inside surfaces of the first and second molded locking features, respectively.

14. The apparatus according to claim 13 wherein the first molded locking feature is separated from the clip for exposing a first portion of the pin such that a lanyard device may be connected to the exposed first portion of the pin.

15. A method of attaching a clip to a housing, the method comprising the steps of:

(a) aligning a holder having a first flange to a clip having a second flange, wherein the first and second flanges each have a boss for receiving a pin therethrough;

(b) pushing a distal end of the pin through the bosses of the first and second flanges for holding the holder and clip rotatably together;

(c) sliding the holder into guides located on the housing until a proximate end of the pin is aligned with a first molded locking feature located on the housing and adjacent to the guides, the holder locking into the guide, and wherein the distal end of the pin is substantially near a second molded locking feature.

16. The method according to claim 15 wherein the second molded locking feature is an integral part of the clip.

17. The method according to claim 16 wherein the second molded locking feature forms a sealed boss and the distal end of the pin is inserted therein.

18. The method according to claim 16 wherein the second molded locking feature is an integral portion of the housing, the second molded locking feature located across from and substantially aligned to the first molded locking feature.

* * * * *